US005234275A

United States Patent [19]

Gueret

[11] Patent Number: 5,234,275

[45] Date of Patent: Aug. 10, 1993

[54] HOLDER FOR A STICK OF COSMETIC MATERIAL

[75] Inventor: Jean-Louis H. Gueret, Paris, France

[73] Assignee: L'Oreal, Paris, France

[21] Appl. No.: 804,740

[22] Filed: Dec. 11, 1991

[30] Foreign Application Priority Data

Dec. 19, 1990 [FR] France ..... 90 15935

[51] Int. Cl.[5] ..... A45D 40/04; A45D 40/12

[52] U.S. Cl. ..... 401/78; 401/80

[58] Field of Search ..... 401/78, 80, 68

[56] References Cited

U.S. PATENT DOCUMENTS

| | | | |
|---|---|---|---|
| 3,272,327 | 9/1966 | Busch | 401/78 |
| 3,515,493 | 6/1970 | Gruska | 401/78 X |
| 3,620,632 | 11/1971 | Gruska | 401/78 |
| 4,514,102 | 4/1985 | Ackerman et al. | 401/78 |
| 4,690,578 | 9/1987 | Idec et al. | 401/78 |
| 4,813,801 | 3/1989 | Cardia | 401/78 X |

*Primary Examiner*—Steven A. Bratlie

*Attorney, Agent, or Firm*—Cushman, Darby & Cushman

[57] ABSTRACT

A device for holding and dispensing a pasty product such as lipstick includes an inner tubular element and an outer casing with the inner tubular element having a slide or channel extending along its length; the outer casing has an interior wall provided with a helical groove and a cup is positioned for slidable movement in the tubular element; the cup is provided with a pin which extends through the slide or channel and engages the helical groove so that relative rotation will effect translation of the cup along the tubular element; a breaking member is positioned between the tubular element and the casing adjacent one end of the device.

6 Claims, 5 Drawing Sheets

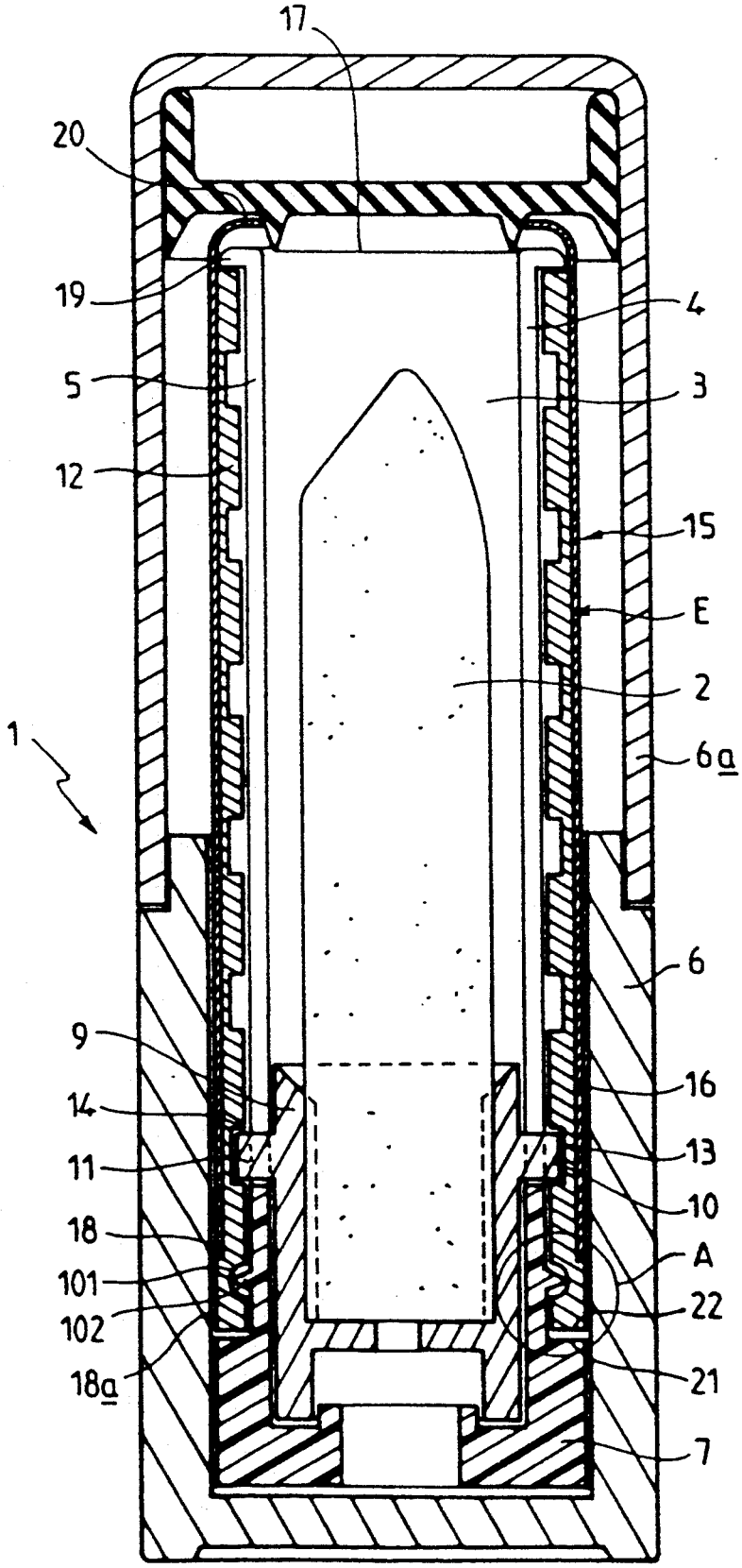
FIG. 1
FIG. 1A
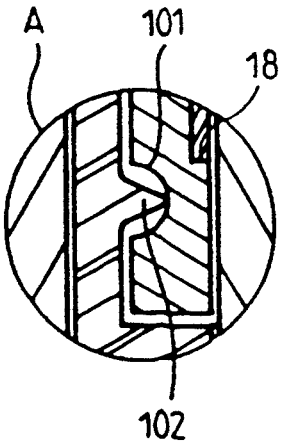

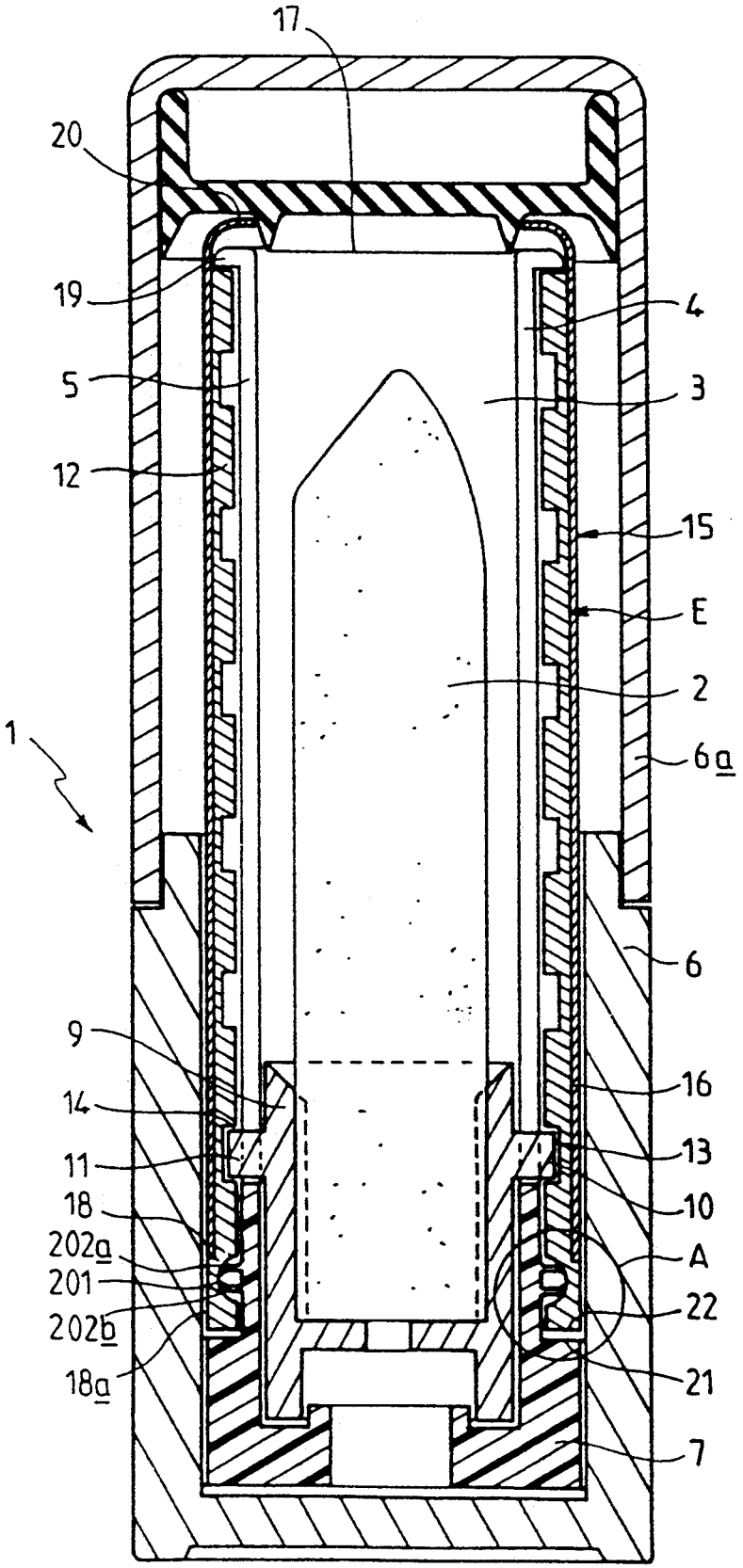
FIG. 2
FIG. 2A
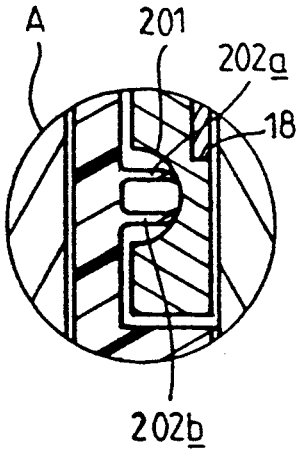

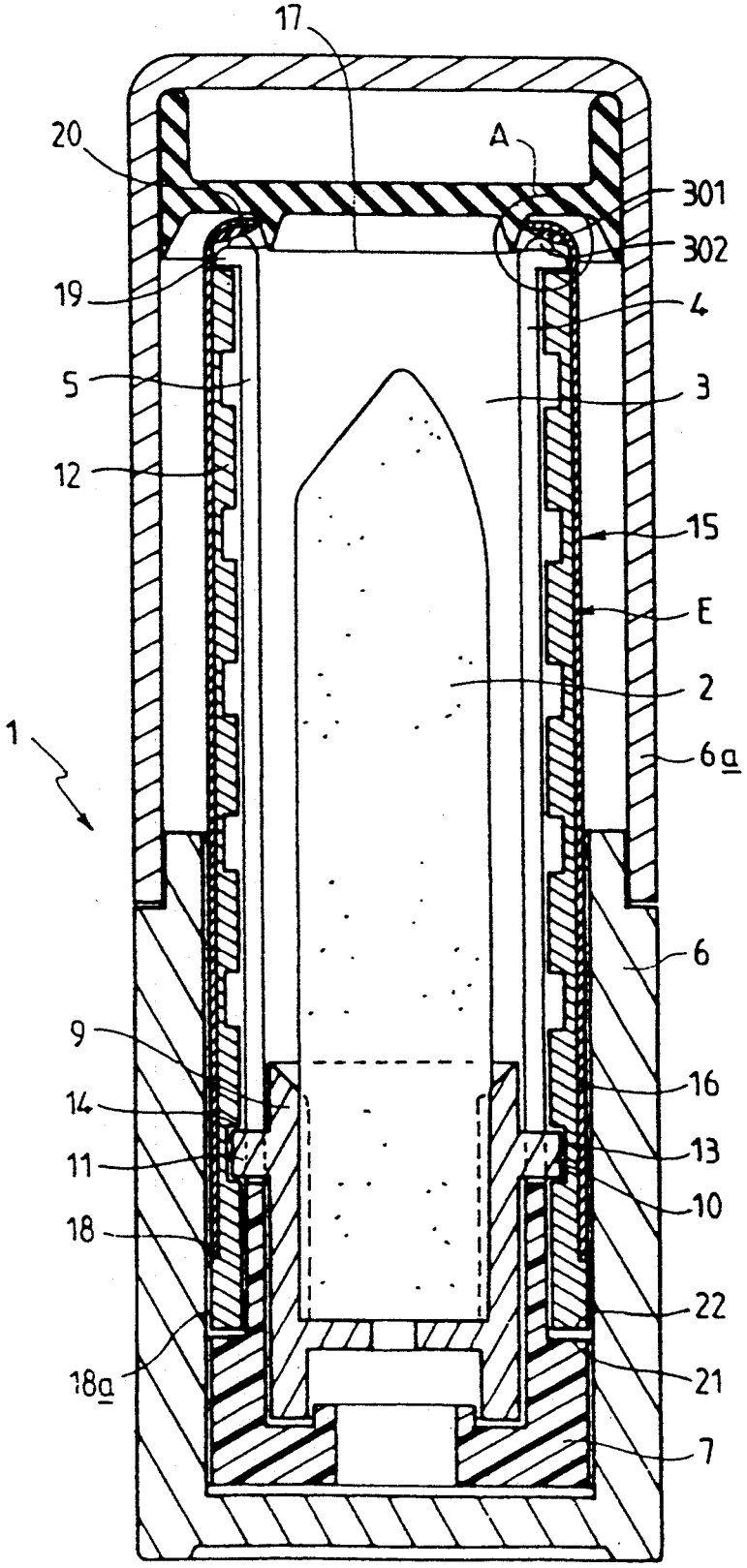
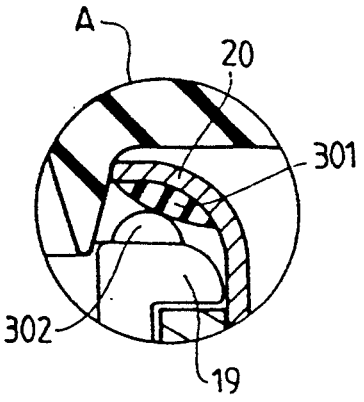
FIG. 3A
FIG. 3

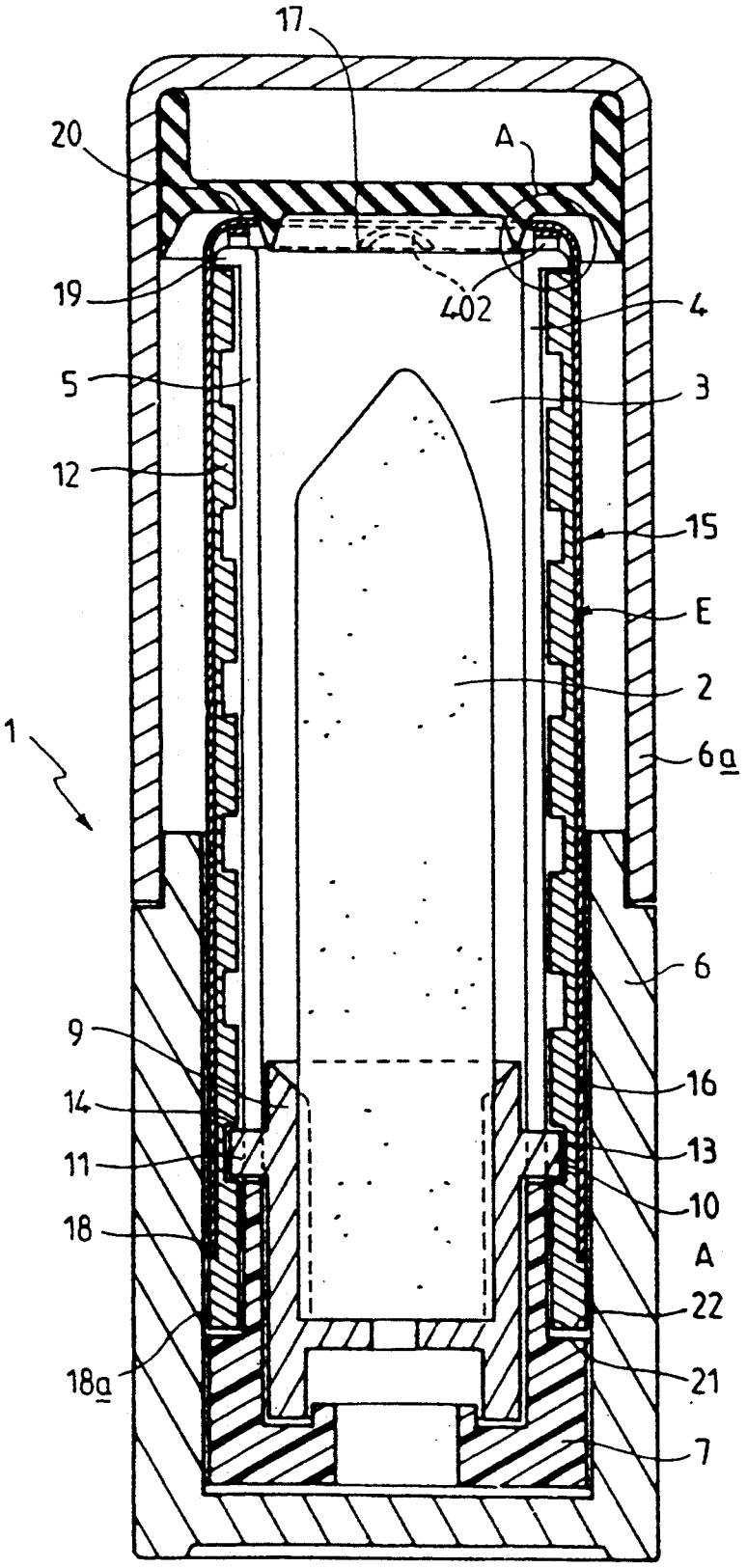
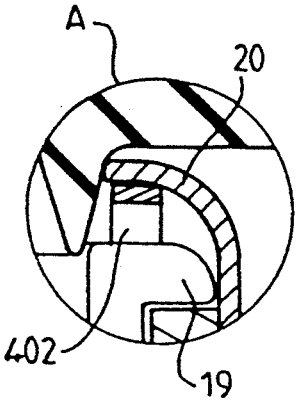
FIG. 4A
FIG. 4

HOLDER FOR A STICK OF COSMETIC MATERIAL

FIELD OF THE INVENTION

The invention relates to a device for the application of a pasty product, especially a cosmetic product such as lipstick, in the form of a stick, said device being of the type comprising a tubular element having a slide, in which a cup adapted to receive the product stick is slidably mounted and having at least one pin engaged in the slide, a cylindrical casing, the wall of which is provided with at least one helical groove, this casing being slipped over the tubular element and being held on the latter by stop means at its two axial ends, the pin(s) of the cup being engaged in the helical groove(s) of the casing, and possibly an outer sleeve, especially of metal, in which the casing is locked, while the tubular element can rotate with respect to the said casing and the said sleeve, the mechanism being such that when the tubular element is rotated with respect to the casing, the cooperation of the pin(s) of the cup and the helix results in axial movement of the cup and delivery or retraction of the product stick in the direction of rotation through an outlet end of the tubular element.

The device is generally provided with a movable protective cap supported by the outer sleeve or by a protective case which at least partially surrounds the device along the axis.

As result of variations in the dimensions of the components of this device, especially the tubular element and the casing, these variations being inevitable in mass production, manufacturing tolerances must be provided for, which, in some cases of assembly, lead to relatively large amounts of play. The device is then relatively loose and as a result of the play present, the tubular element can move slightly with respect to the casing, resulting in inaccurate control of the movement of the pasty product. Moreover, the play gives the user an unfavourable impression of the quality of the product.

DESCRIPTION OF THE PRIOR ART

Various solutions have been proposed hitherto in order to mitigate these disadvantages, especially the use of thick grease, but these do not give complete satisfaction.

In WO-A 86/03658, it is proposed to reduce the operating play by means of elements disposed over arcs of a circle of approximately 15°, and therefore non-annular, or with the aid of a separate annular component.

GB-A 1 118 889 relates to a device for braking the movement of a similar device by means of three radial areas of excessive thickness, which, upon a rotational movement, result in deformation of the thinner wall situated opposite, said deformation moving as rotation is effected.

FR-A 1 501 043 relates to a device for braking any spontaneous movement of the device when the assembly is in the closed position, the means used being essentially situated in the cover.

SUMMARY OF THE INVENTION

The object of the invention is to provide a device for the application of a pasty product of the type described hereinbefore, which satisfies the various requirements of practice better than hitherto and which, in particular, no longer has the disadvantages mentioned hereinabove, or has them to a lesser extent. Moreover, it is desirable for a device of this kind to be simple and economical to manufacture and to ensure "unctuous" operation.

Consequently, this invention relates to a device for the application of a pasty product, especially a cosmetic product such as lipstick, in the form of a stick, comprising a tubular element having a slide(s), in which a cup adapted to receive the product stick is slidably mounted and having at least one pin engaged in the slide, a cylindrical casing, the wall of which is provided with at least one helical groove, this casing being slipped over the tubular element and being held on the latter by stop means at its two axial ends, the pin(s) of the cup being engaged in the helical groove(s) of the casing, and possibly an outer sleeve, in which the casing is locked in order to form an assembly (E) therewith, the tubular element being capable of rotating with respect to the said assembly (E), the mechanism being such that when the tubular element is rotated with respect to the casing, the cooperation of the pin(s) of the cup and the helix of the groove(s) results in axial movement of the cup and delivery or retraction of the product stick in the direction of rotation through an outlet end of the tubular element, the tubular element being provided on its outer wall towards its end remote from the outlet end with lower stop means adapted to rest against the adjacent edge of the cylindrical casing and/or the sleeve when the latter have been slipped over the tubular element, the casing being held in a direction parallel to the axial direction between the said lower stop means and upper stop means provided at the other end of the tubular element, characterised in that at least one means for taking up play and braking the mechanism is interposed between the tubular element and the assembly (E).

In a first embodiment, the means for taking up play and braking is disposed between the tubular element and the casing, in the zone included between the lower stop means and the end of the helical groove(s) the closest thereto, the said groove end(s) being closer to the outlet end than the lower stop means. It is possible to provide that the means for taking up play and braking has an annular recess cooperating frictionally with a male element which penetrates therein, one being carried by the tubular element and the other by the casing. The recess is preferably formed in the casing and the male element is carried by the tubular element. Advantageously, the male element can be an annular ring, which may be continuous or discontinuous. The cross section of the recess can be semi-circular, that of the ring being triangular, the vertex of the triangle pressing against the base of the said recess. As a variant, the ring may consist of two flexible strips pressing against the base of the recess.

According to a second embodiment of the device according to the invention, the casing is surrounded by a sleeve integral therewith, the edge of the said sleeve in the vicinity of the outlet end being folded over the upper stop means, the means for taking up play and braking being provided between the said edge and the said upper stop means. The upper stop means may consist of a collar disposed on the tubular element about the outlet end. The means for taking up play and braking is therefore advantageously a sliding bearing, provided between the folded zone of the edge of the sleeve and the collar. The sliding bearing on the collar is preferably effected on reliefs carried by the said collar. In a first variant, the reliefs are bosses distributed regularly over the collar. In a second variant, the reliefs are flexible strips distributed regularly over the said collar. In a first version, the sliding bearing is produced between the collar and an elastic or plastic seal carried by the folded zone of the edge of the sleeve. In another version, the sliding bearing is produced directly between the collar and the folded edge of the sleeve.

The device is preferably provided with a movable protective cap supported by a protective case which surrounds the entire mechanism or by the outer sleeve, ensuring sealing of the device. The cap advantageously comprises an inner sealing component frictionally sealed to the outer sleeve. This sealing component may also advantageously comprise a double seal obtained by virtue of a double skirt clamped thereto.

BRIEF DESCRIPTION OF THE DRAWINGS

The subject matter of the invention will be more readily understood from the following description of four embodiments given purely by way of non-limiting examples and with reference to the accompanying drawings, in which:

FIG. 1 is an axial section of a device according to the invention for the application of lipstick, the means for taking up play and braking forming the object of a detail A shown on a larger scale;

FIGS. 2 to 4 show three other variants of the device according to the invention, the means for taking up play and braking for each variant being shown on a larger scale in a detail designated by the letter A.

DETAILED DESCRIPTION OF THE INVENTION

Figure 5:
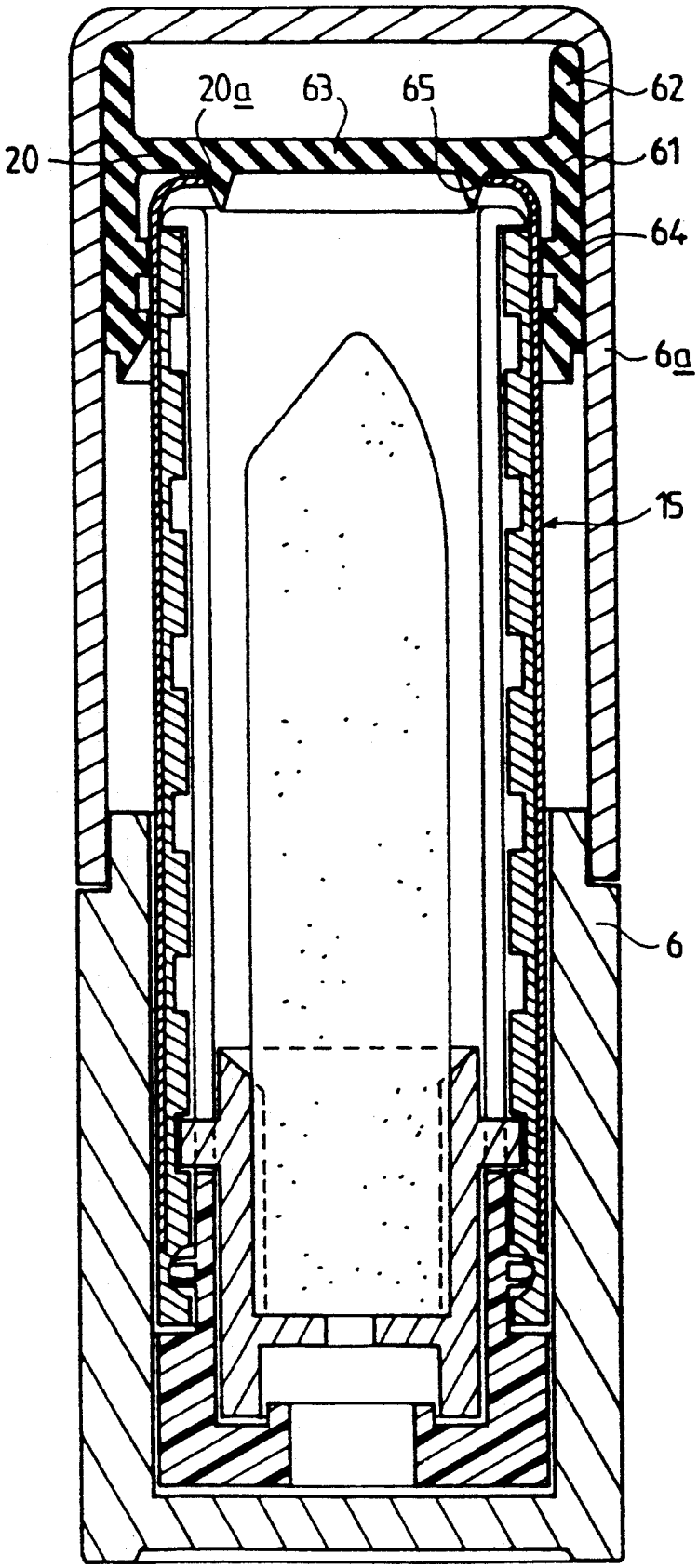
FIG. 5 shows the device illustrated in FIG. 2 comprising a cap ensuring sealing.

The general structure of the device according to the four variants shown in the drawing is exactly the same. Only the means for taking up play and braking used change from one variant to the next. The same reference numerals are therefore used for identical elements in the four variants. Only one description of the device will be given hereinafter, this description applying to all four variants and then being completed for each of the variants by a detailed description of the means for taking up play and braking specifically adopted for each variant.

The device shown in the four figures is adapted for the application of a lipstick in the form of a stick 2. This device is designated in its entirety by the reference numeral 1.

The device 1 comprises a tubular element 3, in which there are provided two diametrically opposing slides 4, 5, formed by slots traversing the wall of the element 3. The upper ends of the slides 4 and 5 are open. The two slides 4 and 5 are closed at their lower ends situated at the side of the base 7 of the tubular element 3. The base 7 is integral with an outer case 6 which surrounds the entire mechanism and supports a movable protective cap 6*a*. The slides 4 and 5 are rectilinear and are bordered by two generatrices of the tubular element 3, which is cylindrical.

A cup 9 adapted to receive the stick 2 is slidably mounted in the tubular element 3. This cup comprises two diametrically opposing pins 10, 11 engaged in the slides 4 and 5 respectively. The pins 10, 11 project radially towards the exterior at a sufficient distance to completely traverse the slides 4 and 5 and to project beyond the outer surface of the element 3.

A cylindrical casing 12 is slipped over the tubular element 3 and is held on the latter by stop means at its two axial ends. The casing 12 comprises in its wall two helical grooves 13, 14 offset by 180° from one another. These grooves 13, 14 are formed by recesses formed in the thickness of the wall of the casing 12. These recesses are closed at their ends. The pins 10 and 11 are engaged by their outer radial ends in the grooves 13 and 14.

The tubular element 3, the cup 9 and the casing 12 are made of plastic material. The casing 12 is locked, especially by jamming or gluing, into an outer metal sleeve 15, the end 16 of which opposite the outlet orifice 17 of the tubular element 3 is received in an annular recess 18 formed on the base 12*a* of the casing 12. The element 3, the base 7 and the outer case 6 are mounted to rotate freely with respect to the casing 12 and the sleeve 15.

It is immediately clear that acting on the case 6 in order to rotate it and the element 3 with respect to the casing 12 and the sleeve 15 results in axial upward and downward movement of the cup 9 and the stick 2 in the direction of rotation, by virtue of the cooperation of the pins 10, 11 and the helical grooves 13, 14.

Stops are provided on the tubular element 3. An upper stop is formed by a collar 19 projecting radially towards the exterior, surrounding the outlet orifice 17 of the tubular element 3. The edge 20 of the sleeve 15 is folded over this collar 19 and defines a through orifice having the same diameter as the orifice 17. The casing 12, having a closed circular contour, has an inner diameter substantially equal to the outer diameter of the element 3 below the collar 19. The outer diameter of the casing 12 is slightly greater than that of the collar 19. The diameter of the base 7 is greater than the outer diameter of the casing 12 and is approximately equal to the outer diameter of the sleeve 15.

The casing 12 is mounted on the tubular element 3 by clipping or snap engagement. To this end, the casing 12 is slipped over the end of the tubular element 3 provided with its collar 19. As a result of the presence of the open upper ends of the slides 4 and 5 in this collar 19, the tubular element 3 can be deformed and the diameter of the collar 19 can be reduced in order to penetrate into the casing 12. When this casing 12 has been penetrated to a sufficient extent, the collar 19 emerges from this casing and resumes its initial dimensions. The adjacent axial end of the casing 12 then rests against the said collar 19, which forms the upper stop.

The lower stop means provided on the element 3 towards its end remote from the outlet orifice 17 are formed by an annular step 21 capable of resting against the adjacent edge 22 of the cylindrical casing 12 when the latter has been slipped over the element 3. The casing 12 is therefore held axially between the collar 19 and the step 21.

The nature of the means for taking up play and braking used in each of the four variants shown in the four figures of the drawing will now be described in detail.

In the variant of FIG. 1, the means for taking up play and braking is produced by the cooperation of an annular recess 101 formed in the base of the casing 12 in the zone situated between the lower end of the said casing and the lower end of the helical grooves 13, 14 and an annular ring 102 carried by the tubular element 3. The ring 102 is disposed between the base of the slides 4 and 5, on the one hand, and, on the other hand, the annular step 21. The ring 102 has a triangular cross section. The recess 101 has a semi-circular cross section. The ring 102 penetrates into the recess 101 and presses against the base of this recess. By virtue of this arrangement, it is possible to take up any play which may exist between the different elements of the mechanism and moreover, by virtue of the support of the ring 102 at the base of the recess 101, this arrangement ensures "unctuous" operation upon the relative rotation of the tubular element 3 and the outer case 6 with respect to the sleeve 15 and the casing 12.

In the variant of FIG. 2, as in the preceding variant, the means for taking up play and braking also comprises a recess 201 carried by the base of the casing 12, a ring carried by the base of the tubular element 3 cooperating with the said recess. The positioning of the recess 201 and the ring is the same as that described for the preceding variant, the only difference being the structure of the ring. In this variant, the cross section of the ring consists of two flexible strips 202*a*, 202*b* which both press against the base of the recess 201, which has a semi-circular cross section as in the preceding case. The action of the means for taking up play and braking is entirely similar to that obtained for the variant of FIG. 1.

In the variant of FIG. 3, the means for taking up play and braking is no longer disposed in the zone of the base 7, but at the opposite end of the device. This means consists of a sliding bearing present between a seal of elastomeric material 301 and bosses 302 carried by the collar 19 which is disposed in the upper part of the tubular element 3. The seal 301 is poured on to the folded edge 20 of the metal sleeve 15 at the side of the base 7. It may consist of a material known by the trade name "Darex". The sliding bearing produced in this manner does not create too great resistance as friction is established solely at the bosses 302. It will be noted that in this case once again excellent taking up of the play of the various elements of the mechanism is obtained and, simultaneously, "unctuous" operation upon rotation of the case 6 with respect to the sleeve 15.

In the fourth variant shown in FIG. 4, the means for taking up play and braking is situated at the same level as that of the variant of FIG. 3, but, in this case, the sliding bearing is produced between flexible strips 402 carried by the upper rim of the collar 19, on the one hand, and, on the other hand, the folded edge 20 of the metal sleeve 15. The strips 402 may advantageously be moulded in one piece with the tubular element 3 and form arches in relief on the collar 19. These flexible strips 402 rub directly against the metal edge 20, without the interposition of an elastic seal. It will be noted that the taking up of play and braking obtained are entirely similar to those obtained for the variant of FIG. 3.

The embodiments described hereinabove are of course in no way limiting and any desired modification is possible without thereby going beyond the scope of the invention.

The device shown in FIG. 5 is similar to the one shown in FIG. 2, except that the cap 6*a* supported by the case 6 carries an inner sealing component 61 consisting of an outer cylindrical skirt 62 having an outer diameter equal, except for the necessary clearance, to the inner diameter of the cap 6*a*, this skirt 62 pressing against the base of the cap 6*a*. This outer skirt 62 surrounds a circular plate 63 disposed at such a distance from the base of the cap 6*a* that in the closed position it rests on the edge 20 of the sleeve 15. The inner wall of the skirt 62 is provided with annular sealing lips 64 which come into contact with the sleeve 15. A double skirt 65 projects from the plate 63 and comes into contact with the rim 20*a* of the edge 20 of the sleeve 15. This gives excellent sealing during storage, this being very important when the cosmetic product in the form of a stick is lipstick, as lipsticks may contain volatile constituents.

I claim:

1. Device for the application of a pasty product, especially a cosmetic product such as lipstick, in the form of a stick, comprising a tubular element having a longitudinal axis, an outlet at one end and a slide extending parallel to said axis, a cup for receiving the stick, said cup being mounted in said tubular element so as to be movable along said axis, said cup having at least one pin extending through said slide, a cylindrical casing having an interior wall and surrounding said tubular element and having a helical groove along said interior wall from adjacent one end thereof to adjacent the opposite end of said interior wall, said pin engaging said groove, said casing having opposite ends engageable with respective stop means, an outer sleeve surrounding said casing, said tubular element being rotatable relative to said casing and said sleeve to effect axial movement of said cup along said tubular element in a direction, corresponding to a direction of rotation, towards or away from said outlet, said tubular element having an opposite end remote from said outlet providing one of said stop means engaging one of said ends of said casing, said casing being held against movement in the axial direction between said one of said stop means and the other of said stop means, said device including a braking means for taking up play and braking movement between said tubular element and said casing;

said braking means being located axially between said one of said stop means of said tubular element and said one end of said interior wall, said helical groove extending along said interior wall closer to said one of said stop means than the other, said braking means comprising a male element and a recess, said male element being located on said tubular element and said casing having said recess, said recess being semi-circular in cross-section in said interior wall and said male element comprising a triangular projection on said tubular element having a vertex pressed into and against said recess.

2. Device for the application of a pasty product, especially cosmetic product such as lipstick, in the form of a stick, comprising a tubular element having a longitudinal axis, an outlet at one end and a slide extending parallel to said axis, a cup for receiving the stick, said cup being mounted in said tubular element so as to be movable along said axis, said cup having at least one pin extending through said slide, a cylindrical casing having an interior wall and surrounding said tubular element and having a helical groove along said interior wall from adjacent one end thereof to adjacent the opposite end of said interior wall, said pin engaging said groove, said casing having opposite ends engageable with respective stop means, an outer sleeve surrounding said casing, said tubular element being rotatable relative to said casing and said sleeve to effect axial movement of said cup along said tubular element in a direction, corresponding to a direction of rotation, towards or away from said outlet, said tubular element having an opposite end remote from said outlet providing one of said stop means engaging one of said ends of said casing, said casing being held against movement in the axial direction between said one of said stop means and the other of said stop means, said device including a braking means for taking up play and braking movement between said tubular element and said casing;

said braking means being located axially between said one of said stop means of said tubular element and said one end of said interior wall, said helical groove extending closer to said one of said stop means than the other, said braking means comprising a male element and a recess, said male element being located on said tubular element and said casing having said recess, said recess being semi-circular in cross-section in said interior wall and said male element comprising two flexible strips pressed into and against said recess.

3. Device according to claim 1 or 2, characterized in that the male element is an annular ring extending about said tubular element.

4. Device according to claim 3, characterised in that the cross section of the recess (201) is semi-circular and the ring consists of two flexible strips (202*a*, 202*b*) pressing against the base of the said recess.

5. Device according to claim 1 or 2, provided with a movable protective cap, characterized in that the cap comprises an inner sealing component frictionally sealed to the outer sleeve.

6. Device according to claim 1 or 2, characterized in that the male element is an annular ring extending discontinuously about said tubular element.

* * * * *